US006867405B2

(12) United States Patent
Shon et al.

(10) Patent No.: US 6,867,405 B2
(45) Date of Patent: Mar. 15, 2005

(54) MAGNETRON FOR MICROWAVE OVENS

(75) Inventors: Jong-Chull Shon, Suwon (KR); Boris V. Rayskiy, Suwon (KR); Chul Kim, Anyang (KR); Hyun-Jun Ha, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 144 days.

(21) Appl. No.: 10/305,001

(22) Filed: Nov. 27, 2002

(65) Prior Publication Data

US 2004/0020924 A1 Feb. 5, 2004

(30) Foreign Application Priority Data

Aug. 5, 2002 (KR) ..... 2002-46169

(51) Int. Cl.[7] ..... H05B 6/78
(52) U.S. Cl. ..... 219/756; 219/761; 315/39.51
(58) Field of Search ..... 219/761, 715, 219/756; 315/39.51, 39.57, 39.53, 39.63, 39.71; 313/238, 333, 341, 337

(56) References Cited

U.S. PATENT DOCUMENTS 4,558,250 A * 12/1985 Tsuzurabara ..... 313/337
5,049,782 A * 9/1991 Aiga et al. ..... 315/39.51
5,635,797 A * 6/1997 Kitakaze et al. ..... 315/39.51
5,861,716 A * 1/1999 Ogura ..... 315/39.51

FOREIGN PATENT DOCUMENTS

| | | |
|---|---|---|
| JP | 06-290712 | 10/1994 |
| KR | 0124402 | 9/1997 |
| KR | 20-0152111 | 7/1999 |

* cited by examiner

*Primary Examiner*—Quang T. Van
(74) *Attorney, Agent, or Firm*—Staas & Halsey LLP

(57) ABSTRACT

A magnetron includes a positive polar cylinder, a plurality of vanes, a filament, upper and lower shields, and upper and lower pole pieces. The vanes are disposed in the positive polar cylinder to constitute a positive polar section. The filament is disposed on an axis of the positive polar cylinder to define an activating space. The upper and lower shields cover a top and bottom of the filament, respectively. The upper and lower pole pieces are disposed to induce magnetic flux into the activating space. The upper shield preferably has a diameter ranging from 6.95 mm to 7.10 mm. Additionally, the lower shield preferably has a diameter ranging from 6.95 mm to 7.10 mm.

25 Claims, 9 Drawing Sheets

MAGNETRON FOR MICROWAVE OVENS

CROSS-REFERENCE TO RELATED APPLICATION

This application claims the benefit of Korean Application No. 2002-46169, filed Aug. 5, 2002, in the Korean Intellectual Property Office, the disclosure of which is incorporated herein by reference.

BACKGROUND OF THE INVENTION

1. Field of the Invention

The present invention relates generally to a magnetron for microwave ovens, and more particularly, to upper and lower shields fixedly attached to a top and bottom of a filament of a magnetron, respectively.

2. Description of the Related Art

Generally, a magnetron is constructed to have an anode and a cathode such that thermions are discharged from the cathode and spirally moved to the anode by an electromagnetic force. A spinning electron pole is generated around the cathode by the thermions and current is induced in an oscillation circuit of the anode, so that oscillation is continuously stimulated. An oscillation frequency of the magnetron is generally determined by the oscillation circuit, and has high efficiency and high output power. The magnetron is widely used in home appliances, such as microwave ovens, as well as industrial applications, such as high-frequency heating apparatuses, particle accelerators and radar systems.

The general construction and operation of the above-described magnetron are briefly described with reference to FIGS. 1 through 3.

As shown in FIG. 1, the magnetron generally includes a positive polar cylinder 101 made of an oxygen free copper pipe or the like, a plurality of vanes 102 disposed in the positive polar cylinder 101 to constitute a positive polar section along with the positive polar cylinder 101, and radially arranged at regular intervals to form a cavity resonator, and an antenna 103 connected to one of the vanes 102 to induce harmonics to an outside. The magnetron also includes a large-diameter strip ring 104 and a small-diameter strip ring 105 disposed on upper and lower portions of the vanes 102, respectively, to alternately and electrically connect the vanes 102 so that the vanes 102 alternately have the same electric potential as shown in FIG. 2.

Rectangular depressions 202 are formed in the vanes 102, respectively, to allow the strip rings 104 and 105 to alternately and electrically connect the vanes 102, and cause each opposite pair of the vanes 102 to be disposed in an inverted manner. According to the above-described construction, each of the pair of opposite vanes 102 and the positive polar cylinder 101 constitute a certain LC resonant circuit.

Additionally, a filament 106 in a form of a coil spring is disposed in an axial center portion of the positive polar cylinder 101, and an activating space 107 is provided between radially inside ends of the vanes 102 and the filament 106. An upper shield 108 and a lower shield 109 are attached to a top and bottom of the filament 106, respectively. A center lead 110 is fixedly welded to a bottom of the upper shield 108 while being passed through a through hole of the lower shield 109 and the filament 106. A side lead 111 is welded to a bottom of the lower shield 109. The center lead 110 and the side lead 111 are connected to terminals of an external power source (not shown), and therefore, forms a closed circuit in the magnetron.

An upper permanent magnet 112 and a lower permanent magnet 113 are provided to apply a magnetic field to the activating space 107 with opposite magnetic poles of the upper and lower permanent magnets 112 and 113 facing each other. An upper pole piece 117 and a lower pole piece 118 are provided to induce rotating magnetic flux generated by the permanent magnets 112 and 113 into the activating space 107. The above-described elements are enclosed in an upper yoke 114 and a lower yoke 115. Cooling fins 116 connect the positive polar cylinder 101 to the lower yoke 115, and radiate heat generated in the positive polar cylinder 101 to the outside through the lower yoke 115.

According to the above-described construction of the magnetron, when power is applied to the filament 106 from the external power source, the filament 106 is heated by operational current supplied to the filament 106, the thermions are emitted from the filament 106, and a group of thermions 301 are produced in the activating space 107 by the emitted thermions as shown in FIG. 3. The group of thermions 301 alternately imparts potential difference to each neighboring pair of the vanes 102 while being in contact with front ends of the vanes 102. The group of thermions 301 is rotated by an influence of the magnetic field formed in the activating space 107, and is moved from one state "i" to another state "f". Accordingly, harmonics corresponding to a rotation speed of the thermion group 301 are generated by oscillation of the LC resonant circuit formed by the vanes 102 and the positive polar cylinder 101, and transmitted to the outside through the antenna 103.

Generally, a frequency is calculated by an equation $$f = \frac{1}{2\pi\sqrt{LC}},$$

where L is an inductance and C is a capacitance. Values of the variables of the above equation are determined by geometrical configurations of circuit elements. Thus, the configurations of the vanes 102 constituting part of the LC resonant circuit are principal factors in determining the frequency of harmonics.

Generally, electric and magnetic fields are generated in an activating space. A plurality of lines shown in the activating space 107 of FIG. 4 represent equipotential surfaces. The electric fields are always generated perpendicularly to the equipotential surfaces. Further, although not shown in FIG. 4, lines of a magnetic force are formed in the activating space 107 by the permanent magnets 112 and 113 disposed in upper and lower portions of the magnetron, respectively. In the magnetron, as a Lorentz force ($F=q(E+vB)$ is exerted on the thermions generated from the filament 106 which functions as the cathode, and used to form the group of thermions 301 under the influence of the electric and magnetic fields in the activating space 107, the thermions are moved toward the vanes 102.

In the above equation, q represents an amount of electric charge, v represents a velocity of the electric charge, E represents an intensity of the electric field, and B represents an intensity of the magnetic field. The magnetic force always acts perpendicularly to a moving direction of the electric charge.

Some of the thermions that are applied with the exerted Lorentz force are moved around upper and lower portions of the filament 106. As shown in FIG. 1, the upper shield 108 has a shape of a hat and the lower shield 109 has a dented top surface. The thermions tend to escape from the activating space 107 due to the magnetic and electric fields formed in empty spaces between the upper shield 108 and the upper pole piece 117, and between the lower shield 109 and the lower pole piece 118, as shown in FIG. 4 (here, the lower shield and the lower pole piece are omitted in FIG. 4). Therefore, a phenomenon in which the thermions escape from the activating space 107 due to the Lorentz force causes an efficiency of the magnetron to decrease. In order to overcome the phenomenon, there has been used a method of mechanically preventing the escape of thermions by changing the geometrical configuration of the upper shield 108 (see FIG. 5A) in the shape of a hat, and changing a top surface of the lower shield 109 (see FIG. 5B) to be dented.

A diameter "A" of the upper shield 108 is 7.5 mm, an outer diameter "B" of an upper inclined portion 108*a* of the upper shield 108 is 6.7 mm, and a diameter "C" of a top portion 108*b* of the upper shield 108 is 5.35 mm. The upper shield 108 may be constructed within a certain error range. A diameter "D" of the lower shield 109 is 7.5 mm, an outer diameter "E" of the upper inclined part 109*a* of the lower shield 109 is 6.9 mm, a height"F" of the lower shield 109 is 2.5 mm, and a height "G" of the upper inclined part 109*a* of the lower shield 109 is 0.5 mm. The lower shield 109 may also be constructed within a certain error range. The conventional upper and lower shields 108 and 109 have relatively large sizes. Thus, the upper and lower shields 108 and 109 are positioned close to the upper and lower pole pieces 117 and 118 across an open space between the upper shield 108 and the upper pole piece 117, and another open space between the lower shield 109 and the lower pole piece 118. As a result, the conventional magnetron attempts to prevent thermions from escaping from an activating space by reducing open spaces through which thermions may escape from the activating space.

When distribution of the electromagnetic field is not uniform in the activating space 107 of the magnetron, electron beams are unstable and noise is emitted to the outside. In the magnetron using the upper and lower shields 108 and 109 shown in FIGS. 5A and 5B, a space charge distribution is typically asymmetrical around the upper and lower shields 108 and 109 in the activating space 107, as shown in FIG. 6. The asymmetry may cause a generation of very high harmonics in the magnetron, thus moving an axis of vanes upwardly and downwardly.

Further, it is ultimately electric and magnetic fields that apply force of a predetermined direction to thermions. Therefore, a suppression of using a mechanical configuration of the upper and lower shields 108 and 109, as shown in FIG. 5, is restrictive. Accordingly, the conventional magnetron is problematic in that it is impossible to fundamentally prevent the escape of thermions.

SUMMARY OF THE INVENTION

Accordingly, it is an object of the present invention to provide a magnetron that is capable of making distributions of electric fields between an upper shield and an upper pole piece and between a lower shield and a lower pole piece, different from conventional distributions by changing size configurations of the upper and lower shields, so that thermions are prevented from escaping due to an electromagnetic technique rather than a mechanical technique. Accordingly, a symmetric distribution of thermions is achieved across an overall activating space, thus reducing noise in the magnetron, and improving efficiency of the magnetron.

Additional objects and advantages of the invention will be set forth in part in the description which follows and, in part, will be obvious from the description, or may be learned by practice of the invention.

The foregoing and other objects of the present invention are achieved by providing a magnetron for microwave ovens including a positive polar cylinder, a plurality of vanes disposed in the positive polar cylinder to constitute a positive polar section along with the positive polar cylinder, and a filament disposed on an axis of the positive polar cylinder, to define an activating space along with front sides of the vanes and emit thermions. The magnetron also includes upper and lower shields to cover a top and bottom of the filament, respectively, and upper and lower pole pieces disposed to be spaced apart from the upper and lower shields to induce magnetic flux into the activating space. The upper shield has a diameter ranging from 6.95 mm to 7.10 mm. The lower shield has a diameter ranging from 6.95 mm to 7.10 mm.

BRIEF DESCRIPTION OF THE DRAWINGS

The above and other objects and advantages of the invention will become apparent and more appreciated from the following description of the preferred embodiments, taken in conjunction with the accompanying drawings of which.

DETAILED DESCRIPTION OF THE PREFERRED EMBODIMENTS

Figure 1:
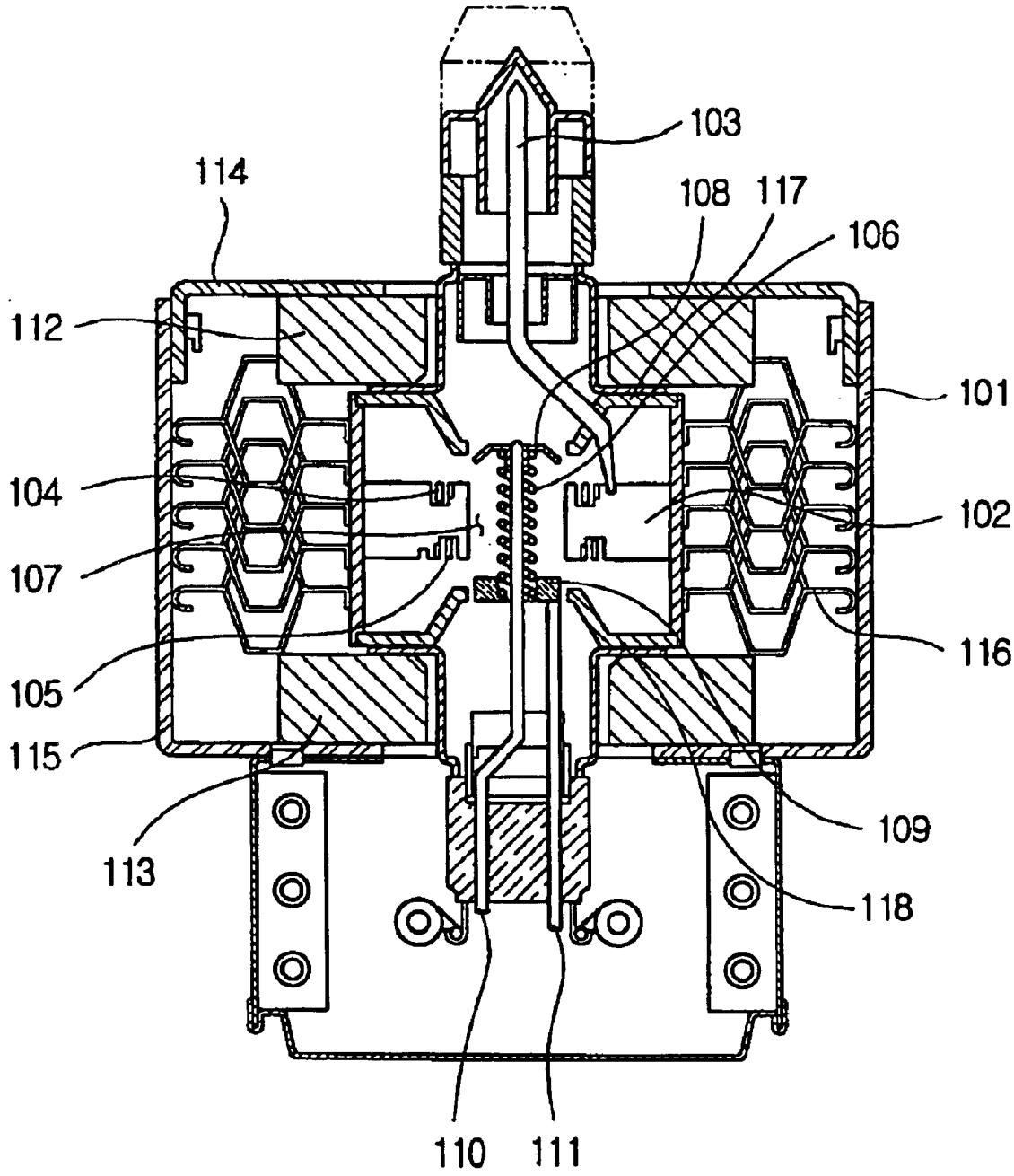
FIG. 1 (Prior Art)
FIG. 1 is a longitudinal section of a conventional magnetron.
Figure 2:
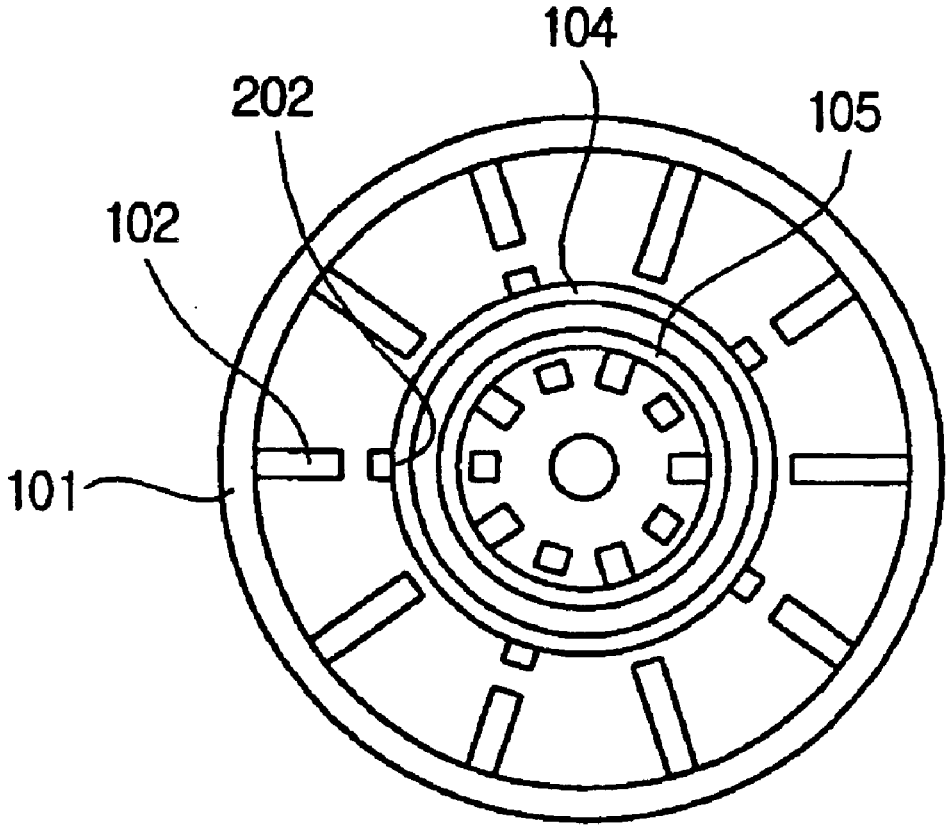
FIG. 2 (Prior Art)
FIG. 2 is a top view showing positive and negative polar sections of the magnetron of FIG. 1.
Figure 3:
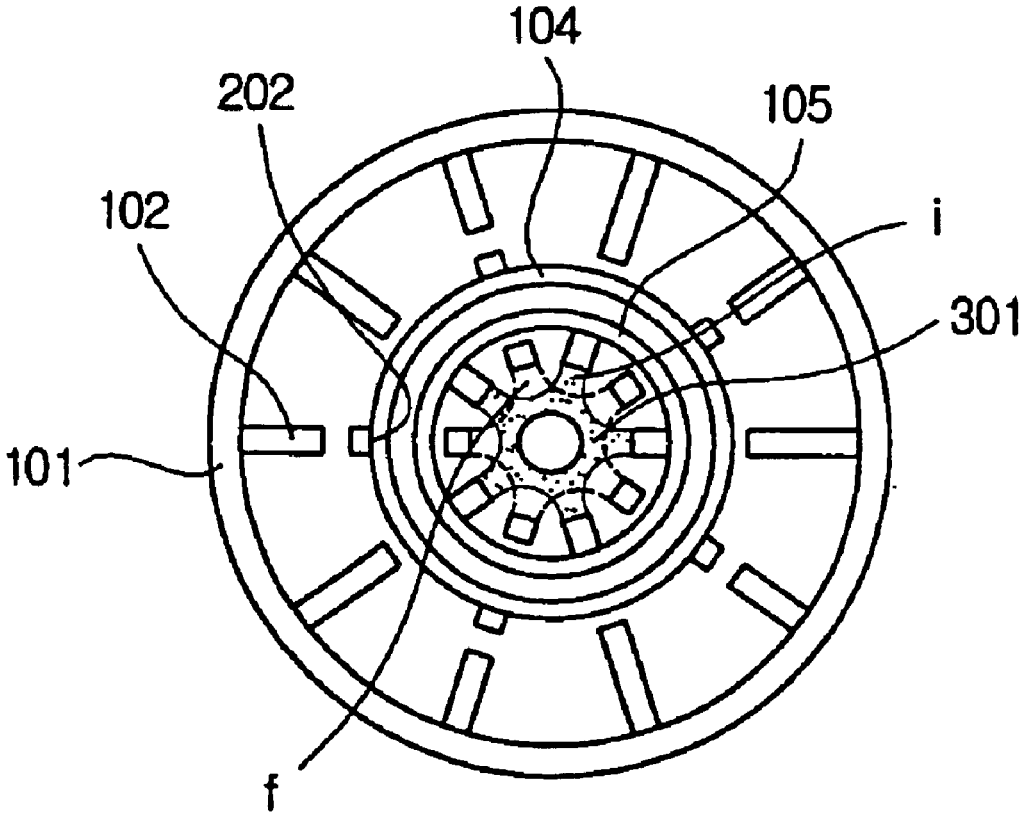
FIG. 3 (Prior Art)
FIG. 3 is a top view showing the positive and negative polar sections of FIG. 2 when the magnetron is in an operating state.
Figure 4:
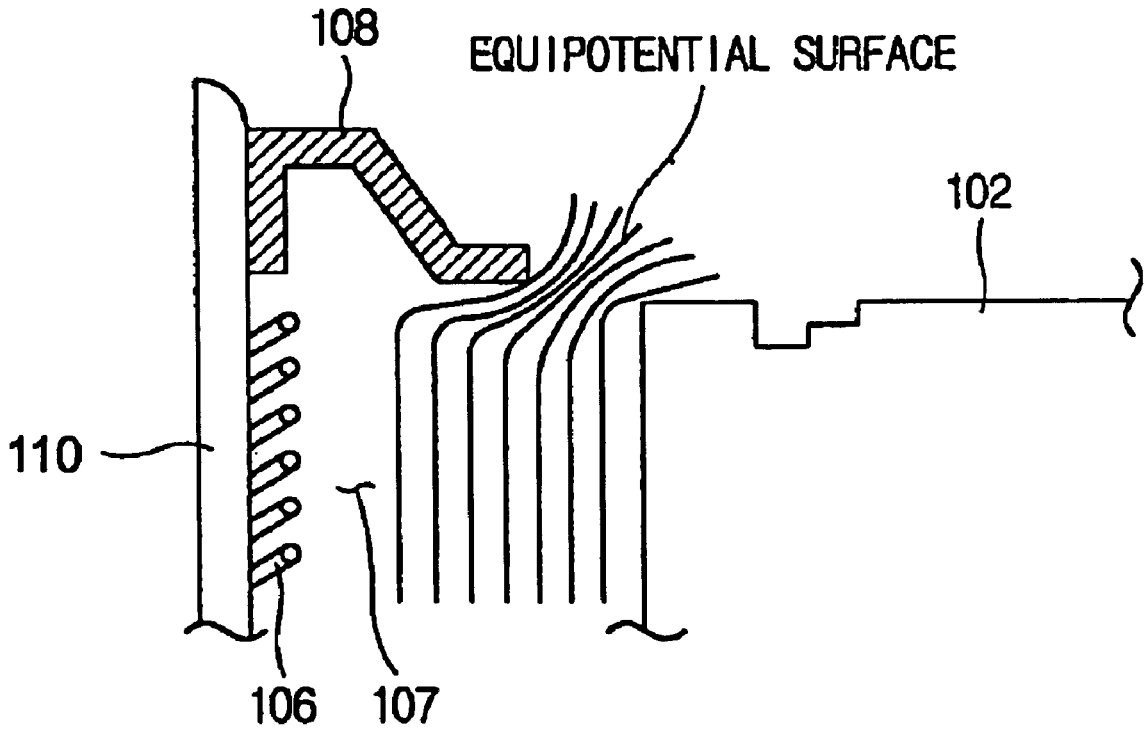
FIG. 4 (Prior Art)
FIG. 4 is a side sectional view showing equipotential surfaces in a conventional activating space.
Figure 5A:
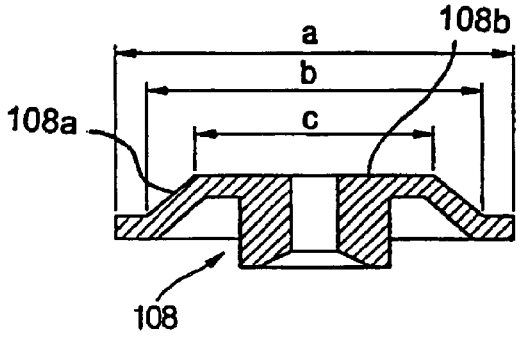
FIG. 5A (Prior Art)
FIGS. 5A and 5B are longitudinal sectional views showing conventional upper and lower shields of the conventional magnetron.
Figure 5B:
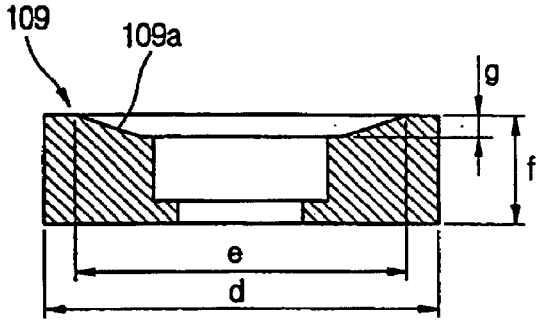
FIG. 5B (Prior Art)
Figure 6:
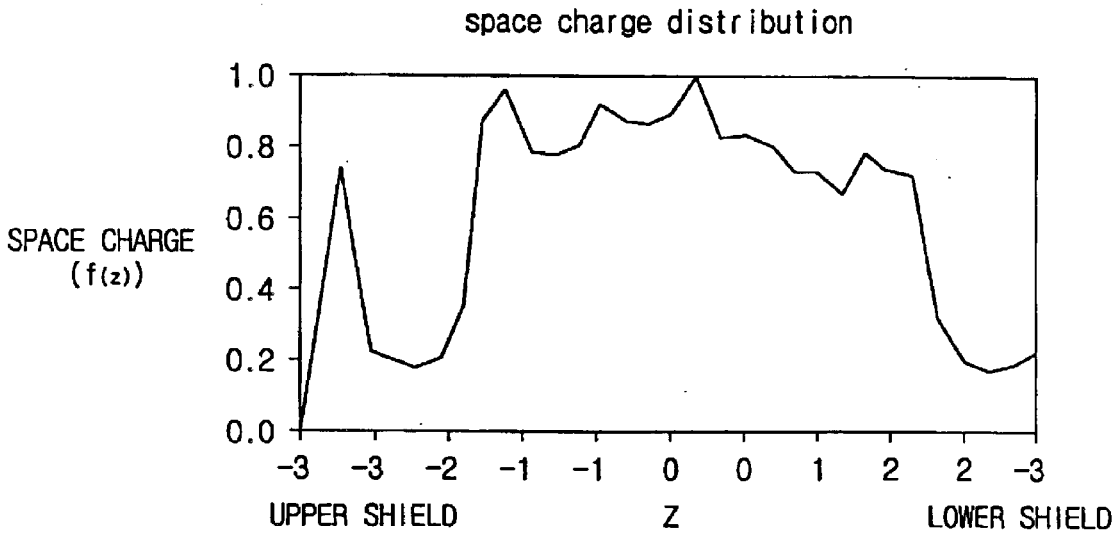
FIG. 6 (Prior Art)
FIG. 6 is a graph showing a space charge distribution in the conventional activating space.

Reference will now be made in detail to the present preferred embodiments of the present invention, examples of which are illustrated in the accompanying drawings, wherein like reference numerals refer to like elements throughout.

Generally, the asymmetry of a space charge distribution in an activating space cannot be determined by configurations of vanes or a filament in view of characteristics of the space charge distribution. This is because the vanes and the filament are arranged to be symmetrical, and the vanes face each other on opposite sides of the filament. On the contrary, the space charge distribution in the activating space is determined by upper and lower shields arranged on a top and bottom of the filament. Accordingly, the space charge distribution in the activating space may be adjusted by changing geometrical configurations of the upper and lower shields. The present invention adjusts the space charge distribution in the activating space, and partially adjusts electric and magnetic fields by changing the geometrical configurations of the upper and lower shields so that outwardly directed force is prevented from acting on electric charges, thus preventing thermions from escaping from the activating space.

The present invention will be described in detail with reference to FIGS. 7 through 9. For simplicity of description, the same constructions and operations as those of the conventional magnetron may be omitted.

Figure 7:
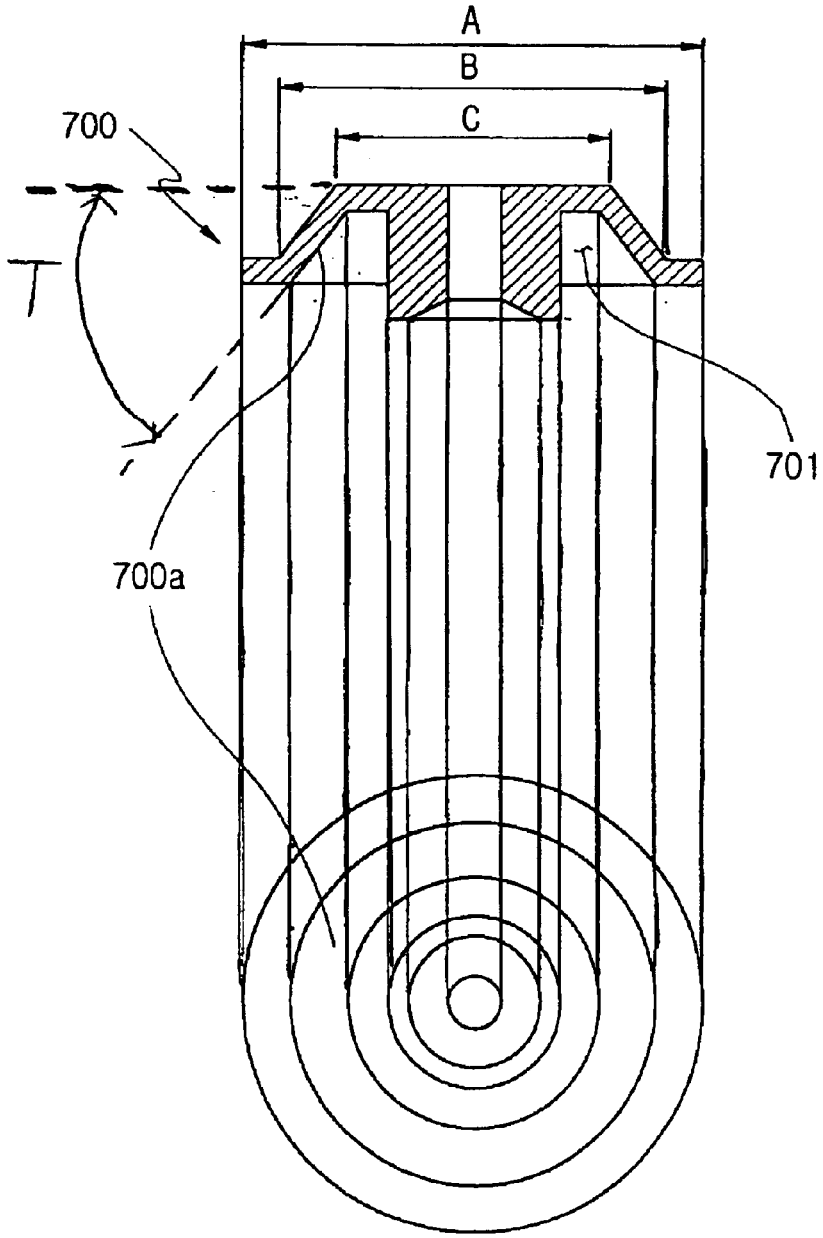
FIG. 7 is a view showing an upper shield, according to an embodiment of the present invention.

FIG. 7 is a diagram showing an upper shield 700, according to an embodiment of the present invention. As shown in FIG. 7, a longitudinal section of the upper shield 700 is illustrated in an upper portion of the drawing, and a bottom view of the upper shield 700 (that is, a bottom surface of the upper shield 700 facing a tower shield) is illustrated on a lower portion of the drawing. In FIG. 7, a diameter "A" of the upper shield 700 is 7.00 mm, an out diameter "B" of an upper inclined portion of the upper shield 700 is 5.60 mm, and a diameter "C" of a top portion of the upper shield 700 is 4.80 mm. The upper shield 700 is constructed within a certain error range. Consequently, an overall size of the upper shield 700 is reduced, so an angle "T" formed by the upper inclined part 700*a* and a top of the upper shield 700 is increased in comparison with that of a conventional upper shield. As a result, electric an magnetic fields are changed by the increase of the angle "T" and the space charge distribution in the activating space is also changed. In FIG. 7, reference numeral 701 denotes a filament accommodating hole.

Figure 8:
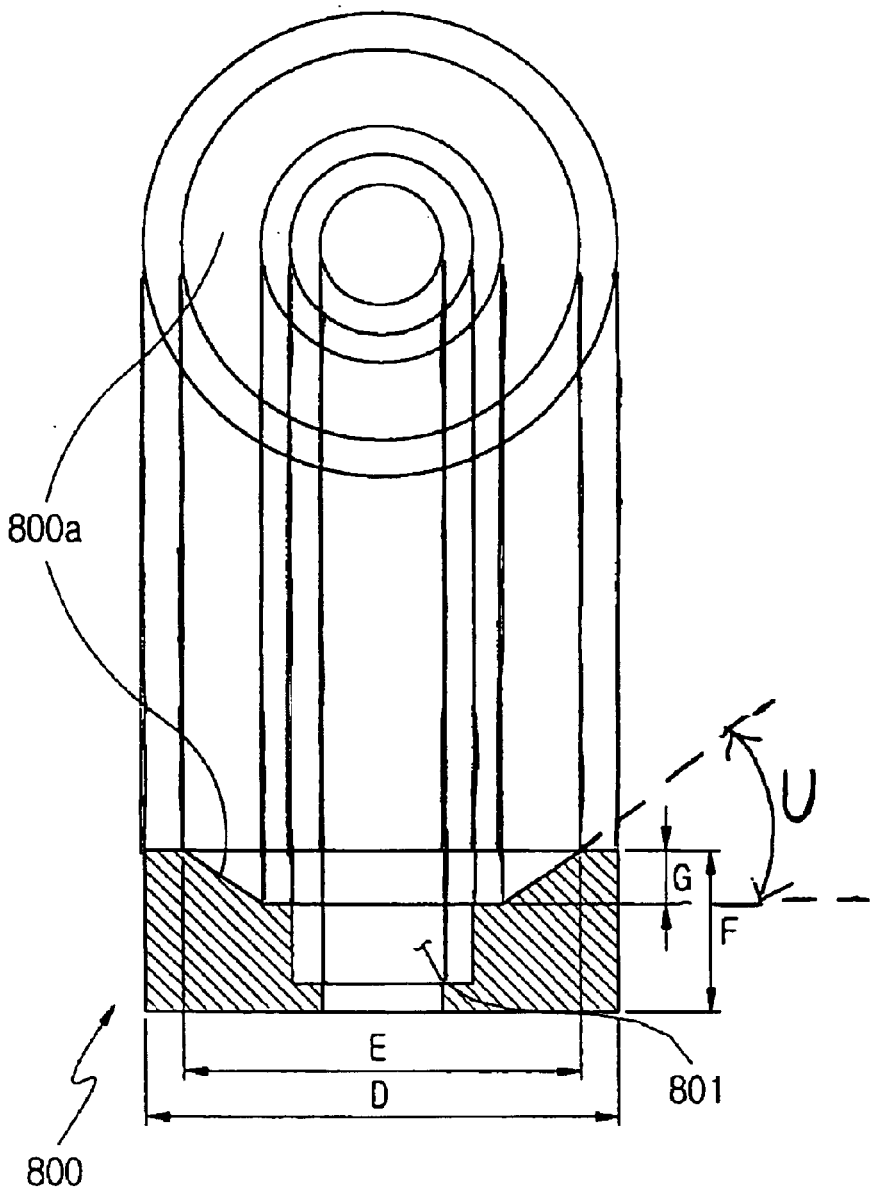
FIG. 8 is a view showing a lower shield, according to another embodiment of the present invention.

FIG. 8 is a diagram showing a lower shield 800, according to another embodiment of the present invention. As shown in FIG. 8, a top view of the lower shield 800 (that is, a top surface of the lower shield 800 facing the upper shield 700) is illustrated on an upper portion of the drawing, and a longitudinal section of the lower shield 800 is illustrated in a lower portion of the drawing. In FIG. 8, a diameter "D" of the lower shield 800 is 7.0 mm, an outer diameter "E" of an upper inclined part 800*a* of the lower shield 800 is 5.0 mm, a height "F" of the lower shield 800 is 2.4 mm, and a height "G" of the upper inclined part 800*a* of the lower shield 800 is 0.4 mm. The lower shield 800 is also constructed within a certain error range. Consequently, an overall size of the lower shield 800 is reduced, so that an angle "U" formed by the upper inclined part 800*a* and a bottom of the lower shield 800 is increased in comparison with that of the conventional lower shield. As a result, electric and magnetic fields are changed by the increase of the angle "U" and the space charge distribution in the activating space is also changed. In FIG. 8, reference numeral 801 denotes the filament accommodating hole.

An operation of the magnetron of the present invention, which is equipped with the upper and lower shields 700 and 800 having the above-described configurations, is described below.

When external power is applied to center and side leads, the filament acts as a cathode and emits thermions, and the vanes and the positive polar cylinder act as an anode. The emitted thermions are moved toward front sides of the vanes under the influence of electric and magnetic fields. In this case, distributions of electric and magnetic fields in a part of the activating space among the upper shield 700, the vanes and an upper pole piece and another part of the activating space among the lower shield 80, and the vanes and a lower pole piece, are changed to be different from that of the conventional magnetron. Therefore, in the magnetron of the present invention, outwardly directed electromagnetic force is significantly reduced, thus preventing the thermions from escaping from the activating space.

Figure 9:
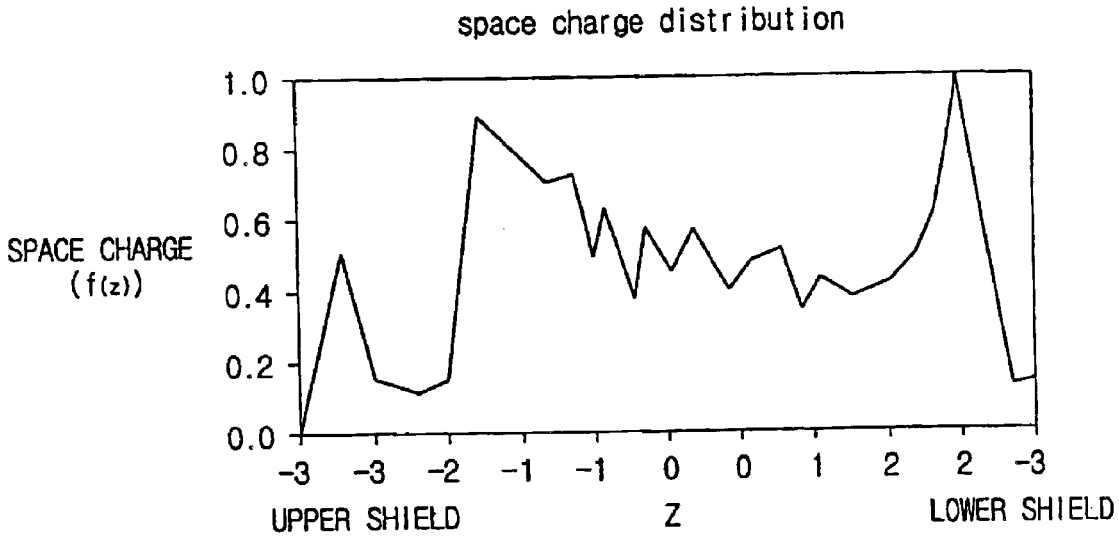
FIG. 9 is a graph showing a space charge distribution in an activating space of the present invention.

FIG. 9 is a graph showing a space charge distribution of thermions in the activating space of the magnetron of the present invention. A vertical axis of the graph designates a space charge density, while a horizontal axis of the graph designates positions of the filament ranging from the top of the filament to the bottom of the filament. The positions of the filament are designated on the horizontal axis as "Z" with "0" assigned to a center of the filament. Accordingly, a left part of the horizontal axis of the graph is a region in which the upper shield 700 exists and to which "−" sign is assigned, while the right part of the horizontal axis of the graph is a region in which the lower shield 800 exists and to which "+" sign is assigned. If the activating space is folded in two around a point "0" (the center of the filament), halves of the curve substantially overlap each other. Accordingly, it is appreciated from the graph that the distribution of thermions is almost symmetrical across the activating space.

The present invention is different from the prior art which attempts to prevent thermions from escaping from an activating space using the geometrical configurations of upper and lower shields. Thus, the present invention uses a natural principle in which thermions are moved by electromagnetic force. The prior art reduces an open space by enlarging upper and lower shields to be positioned close to upper and lower pole pieces, respectively, whereas the present invention increases an open space by reducing sizes of upper and lower shields, thus achieving a symmetrical distribution of thermions by changing the electric and magnetic fields.

The present invention is not limited to the above, but may be successfully implemented within a certain error range of about 0.05 mm with respect to the configurations of the upper and lower shields. In addition, all the variations and modifications, including the concept of changing electric and magnetic fields in an activating space by changing the sizes of the upper and lower shields, and changing the distribution of thermions in the activating space by changing the electric and magnetic fields, fall within the scope of the present invention. Accordingly, those skilled in the art may easily implement variations and modifications in light of the above-described features.

As described above, the present invention provides a magnetron, which is capable of changing shapes of electric and magnetic fields formed around upper and lower shields by changing the geometric configurations of the upper and lower shields (the sizes of the upper and lower shields) to be different from those of conventional upper and lower shields. As a result, efficiency of the magnetron is improved by preventing thermions from escaping from an activating space, noise is reduced, and microwaves of stable frequency are generated by symmetrically distributing thermions in the activating space, thereby improving an overall performance of the magnetron.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A magnetron for microwave ovens, comprising:

a positive polar cylinder;

a plurality of vanes disposed in the positive polar cylinder, to constitute a positive polar section along with the positive polar cylinder;

a filament disposed on an axis of the positive polar cylinder, to define an activating space along with front sides of the vanes and emit thermions;

upper and lower shields to cover a top and a bottom of the filament, respectively; and upper and lower pole pieces disposed to be spaced apart from the upper and lower shields to induce magnetic flux into the activating space, wherein the upper shield has a diameter ranging from 6.95 mm to 7.10 mm.

2. The magnetron according to claim 1, wherein the upper shield has a diameter of 7.00 mm.

3. The magnetron according to claim 1, wherein the upper shield has an outer diameter of an upper inclined part ranging from 5.55 mm to 5.70 mm.

4. The magnetron according to claim 3, wherein the upper shield has an outer diameter of an upper inclined part of 5.60 mm.

5. The magnetron according to claim 1, wherein the upper shield has a diameter of a top flat part ranging from 4.75 to 4.85 mm.

6. The magnetron according to claim 5, wherein the upper shield has a diameter of a top flat part of 4.80 mm.

7. The magnetron according to claim 1, wherein the lower shield has a diameter ranging from 6.95 mm to 7.10 mm.

8. The magnetron according to claim 7, wherein the lower shield has a diameter of 7.00 mm.

9. The magnetron according to claim 7, wherein the lower shield has an outer diameter of an upper inclined part ranging from 4.95 mm to 5.20 mm.

10. The magnetron according to claim 7, wherein the lower shield has an outer diameter of an upper inclined part of 5.00 mm.

11. The magnetron according to claim 7, wherein the lower shield has a total height ranging from 2.35 to 2.45 mm.

12. The magnetron according to claim 11, wherein the lower shield has a total height of 2.40 mm.

13. The magnetron according to claim 7, wherein the lower shield has a height of an upper inclined surface ranging from 0.35 to 0.45 mm.

14. The magnetron according to claim 7, wherein the lower shield has a height of an upper inclined surface of 0.40 mm.

15. A magnetron for microwave ovens, comprising:

a positive polar cylinder;

a plurality of vanes disposed in the positive polar cylinder, to constitute a positive polar section along with the positive polar cylinder;

a filament disposed on an axis of the positive polar cylinder, to define an activating space along with front sides of the vanes and emit thermions;

upper and lower shields to cover a top and a bottom of the filament, respectively; and upper and lower pole pieces disposed to be spaced apart from the upper and lower shields to induce magnetic flux into the activating space, wherein the lower shield has a diameter ranging from 6.95 mm to 7.10 mm.

16. The magnetron according to claim 15, wherein the lower shield has a diameter of 7.00 mm.

17. The magnetron according to claim 15, wherein the lower shield has an outer diameter of an upper inclined part ranging from 4.95 mm to 5.20 mm.

18. The magnetron according to claim 17, wherein the lower shield has an outer diameter of an upper inclined part of 5.00 mm.

19. The magnetron according to claim 15, wherein the lower shield has a total height ranging from 2.35 to 2.45 mm.

20. The magnetron according to claim 19, wherein the lower shield has a total height of 2.40 mm.

21. The magnetron according to claim 15, wherein the lower shield has a height of an upper inclined surface ranging from 0.35 to 0.45 mm.

22. The magnetron according to claim 21, wherein the lower shield has a height of an upper inclined surface of 0.40 mm.

23. A magnetron for a microwave oven, comprising:

a positive polar cylinder;

a plurality of vanes disposed in the positive polar cylinder, to constitute a positive polar section along with the positive polar cylinder;

a filament disposed on an axis of the positive polar cylinder, to define an activating space along with front sides of the vanes and emit thermions;

upper and lower shields to cover a top and a bottom of the filament, respectively; and upper and lower pole pieces spaced apart from the upper and lower shield to induce magnetic flux into the activating space, wherein a diameter of the upper shield ranges from 6.95 mm to 7.10 mm and a diameter of the lower shield ranges from 6.95 mm to 7.10 mm, to change electric and magnetic fields in the activating space, thereby preventing thermions emitted by the filament from escaping the activating space.

24. The magnetron according to claim 23, wherein the diameter of the upper and lower shields are configured so that an electromagnetic force acting on electric charges in the activating space is reduced, thereby preventing the thermions from escaping the activating space.

25. A magnetron for microwave ovens, comprising:

upper and lower shields to cover a top and a bottom of a filament in the magnetron; and upper and lower pole pieces spaced apart from the upper and lower shields to induce magnetic flux into an activating space provided therebetween, wherein a diameter of the upper shield ranges from 6.95 mm to 7.10 mm and a diameter of the lower shield ranges from 6.95 mm to 7.10 mm, to change electric and magnetic fields in the activating space, thereby preventing thermions emitted by the filament from escaping the activating space.

* * * * *

UNITED STATES PATENT AND TRADEMARK OFFICE

CERTIFICATE OF CORRECTION

PATENT NO. : 6,867,405 B2
DATED : March 15, 2005
INVENTOR(S) : Jong-Chull Shon et al.

It is certified that error appears in the above-identified patent and that said Letters Patent is hereby corrected as shown below:

Column 8,
Line 28, change "shield" to -- shields --.

Signed and Sealed this

Twenty-ninth Day of November, 2005

JON W. DUDAS
*Director of the United States Patent and Trademark Office*